United States Patent [19]

Dotzman

[11] Patent Number: 4,464,440

[45] Date of Patent: Aug. 7, 1984

[54] TROPHY MOUNT

[76] Inventor: John G. Dotzman, 8029 Meadow La., Leawood, Kans. 66206

[21] Appl. No.: 481,819

[22] Filed: Apr. 4, 1983

[51] Int. Cl.[3] ..... B44C 5/02; G09F 19/00

[52] U.S. Cl. ..... 428/542.4; 428/16; 428/913.3; 434/296

[58] Field of Search ..... 428/16, 542.4, 913.3; 434/295–296

[56] References Cited

U.S. PATENT DOCUMENTS

| | | | |
|---|---|---|---|
| 453,008 | 5/1891 | Kaempfer | 428/542.4 X |
| 2,003,896 | 6/1935 | Menger | 434/296 |
| 2,851,806 | 9/1958 | Moravec, Jr. | 428/913.3 X |
| 3,301,728 | 1/1967 | Swartz | 156/220 |
| 3,319,922 | 5/1967 | Christensen | 428/913.3 X |

*Primary Examiner*—Henry F. Epstein

*Attorney, Agent, or Firm*—Schmidt, Johnson, Hovey & Williams

[57] ABSTRACT

An improved trophy mount is provided for inexpensively displaying horns, antlers and the like, in a life-like, three-dimensional fashion. The mount preferably includes a simulated skull structure, configured to resemble the upper portion of the head of the animal involved, with the simulated skull encapsulated in a material, such as leather, vinyl, or other sheet material, to enhance its realistic appearance. The simulated skull includes a pair of upraised laterally spaced, horn-securing regions, an elongated bore in each region, and an elongated, horn-receiving dowel secured in each bore and protruding therefrom. Preferably, the simulated skull is secured to a plaque or support panel by an elongated, obliquely-oriented extension brace for display on a wall or table top. For mounting, the horns are removed from the animal at the base, where the horns join the head of the animal. Holes are axially drilled in the base of each horn and each horn secured to the trophy mount by sliding the hole in the horn over the dowel and gluing it in place.

6 Claims, 5 Drawing Figures

Fig. 1
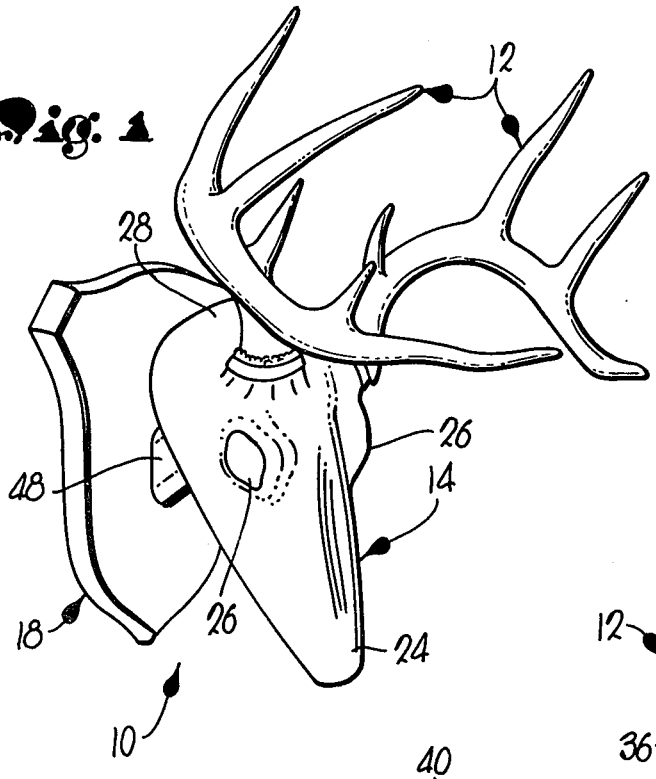
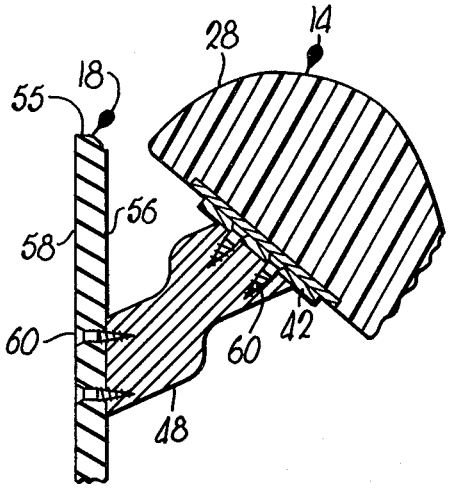
Fig. 3
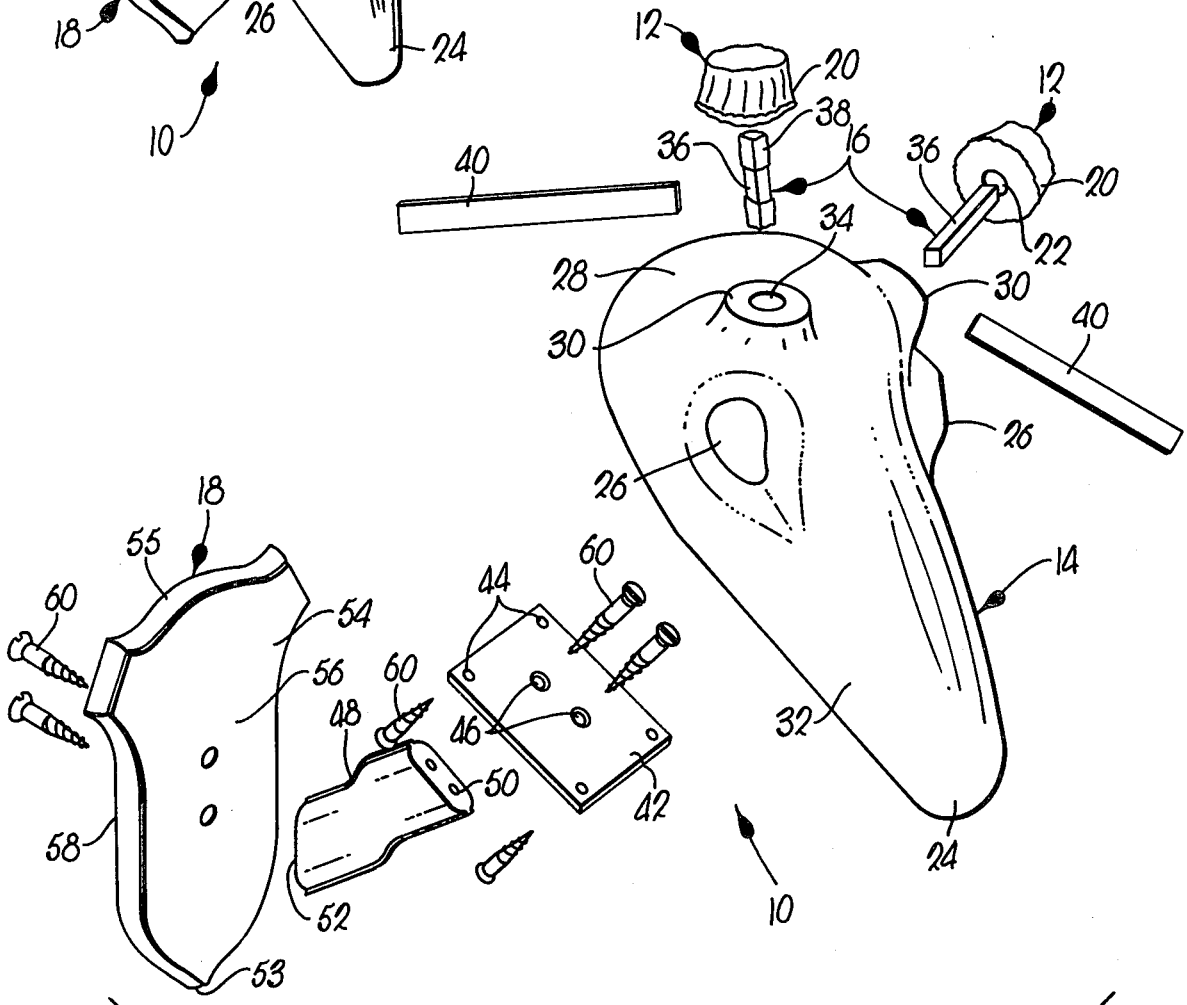
Fig. 2

TROPHY MOUNT

BACKGROUND OF THE INVENTION

1. Field of the Invention

This invention relates to a trophy mount for displaying horns, antlers, and the like, in a life-like, three-dimensionsal fashion which has numerous advantages including realistic appearance, ease of assembly and mounting, and modest cost. More particularly, it is concerned with a trophy mount which includes a simulated skull structure configured to resemble the upper portion of the head of the animal involved (such as a deer, antelope, elk, etc.), with the skull structure having bores drilled therein corresponding to the actual location of the horns for an animal in the wild. The horns or antlers are removed from the animal at the joinder thereof to the head, and a hole is then axially drilled into the joinder end of each horn. The mounting of the horns to the simulated skull structure is completed by gluing a dowel into each hole in the simulated skull structure, sliding the corresponding hole in each horn or antler over the associated dowel, and gluing the antler in place such that the antlers are spaced apart in a life-like manner.

2. Description of the Prior Art

Many ruminant animals, whether domesticated or wild, have horns, antlers, or the like, which can be attractive when mounted for display. Particularly attractive is the rack (antlers, horns or the like) taken from a game animal by a hunter. The most common method of mounting such a rack is to employ a taxidermist to mount the rack in a life-like manner, but this method involves long delays in mounting the rack and is often very expensive. Alternatively, trophy mounts have been proposed wherein the skull structure of the animal between the horns is excised from the head along with the horns in one piece, and the skull piece then attached to a plaque for display. Although this method saves the expense of employing a taxidermist, it is deficient in that the rack is not displayed in a life-like manner, and the process of excising the skull piece from the head often involves extraordinary skill. A patent illustrating this type of trophy mount is U.S. Pat. No. 3,319,922.

SUMMARY OF THE INVENTION

The problems outlined above are in large measure solved by the trophy mount in accordance with the present invention. That is, the trophy mount hereof is inexpensive, simple to complete, and displays the animal's rack in a life-like, three-dimensional manner.

The trophy mount in accordance with the present invention broadly includes a simulated skull structure, configured to resemble the upper portion of the head of the animal involved, a pair of upraised horn-receiving regions symmetrically spaced on the simulated skull at the approximate location of the horns on an animal in the wild, and horn mounting means for securing the antlers to the horn-receiving regions. Preferably, the trophy mount includes a plaque having an outwardly extending brace, which in turn supports the assembled antlers and simulated skull, such that the rack is displayed in a more life-like manner.

In particularly preferred forms, the means for mounting the antlers to the simulated skull structure includes a central, elongated bore in each of the horn-securing regions and an outwardly extending dowel, received and adhesively secured in each of the bores. Advantageously, the horns are removed from the animal at the joinder of the horns to the skull and the spacing between horns is noted. An axial hole is drilled in the joinder end of each of the horns and the respective horn is slidingly received on each dowel and adhesively secured thereto, such that the horns are spaced apart approximately the same distance as they were on the animal to give a more natural appearance.

BRIEF DESCRIPTION OF THE DRAWINGS

FIG. 1 is a perspective view of the trophy mount in accordance with the invention;

FIG. 2 is an enlarged, fragmentary, exploded view illustrating the components of the trophy mount in accordance with the invention;

FIG. 3 is a vertical sectional view illustrating the attachment of the simulated skull structure to a plaque;

DESCRIPTION OF THE PREFERRED EMBODIMENT

Figure 4:
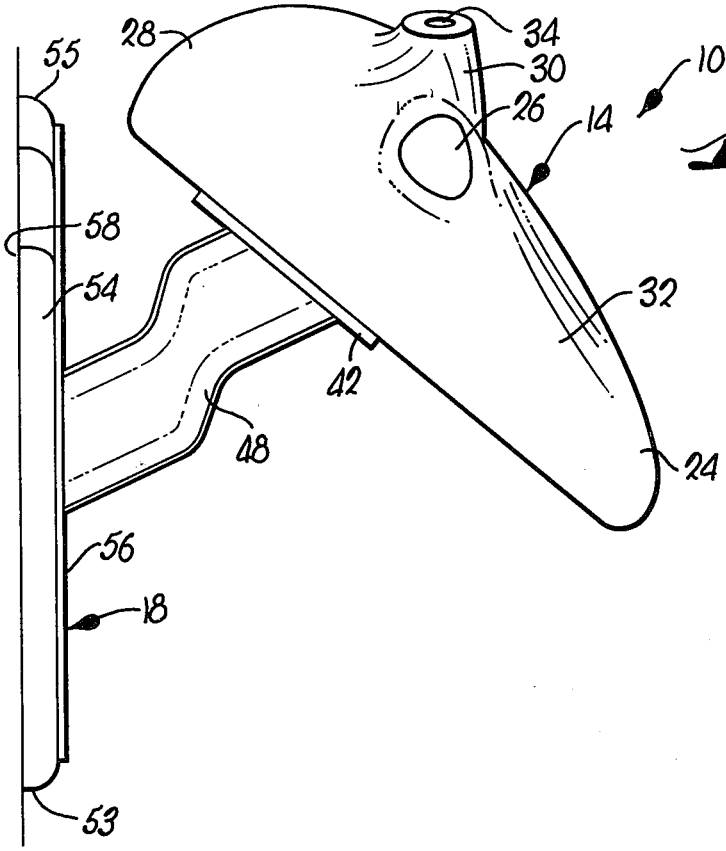
FIG. 4 is a side elevational view of the trophy mount, configured for display on a vertical surface, such as a wall.

Referring now to the drawing, a trophy mount 10 for displaying horns 12 broadly includes simulated skull structure 14, configured to resemble a portion of the head of an animal, mounting means 16 structured to secure the horns 12 to the simulated skull 14, and a display support 18, configured to secure the trophy mount 10 to a wall, table or other support surface in a like-like, three-dimensional manner.

The horns or antlers 12 for display by the trophy mount 10 of the present invention, would typically be the rack from a game animal's head, such as a deer, antelope, elk, moose, etc., although the horns from any ungulate animal, such as long-horn cattle, can be displayed by the trophy mount 10 of the present invention. Before the horns 12 are removed from the game animal's head, measurements are taken between the horns at various locations, and measurements also taken between a fixed datum on the head, such as the bridge of the nose, to various positions on the horns 12, such that the relative position of the horns 12 on the game animal's head is approximated. The horns 12 are then cut from the skull of the animal at the base of the horns 20. An elongated hole 22 is axially drilled into the horn base 20 as shown in FIG. 2.

The simulated skull structure 14 is preferably made of a molded synthetic resin material to resemble the upper portion of a game animal's head. In most animals, the simulated skull 14 would include a somewhat elongated nose portion 24, eye projections 26, and an enlarged, rounded cerebrum portion 28 (the neck of the animal could be included, if desired). The simulated skull additionally includes a pair of laterally spaced, symmetrically oriented, horn-securing regions 30, upraised slightly from the surface of the simulated skull 14. As may be appreciated, the exact location of the horn regions 30 upon the simulated skull 14 will vary depending upon the game animal involved, but as seen in FIGS. 1 and 2, the regions 30 are preferably located on the cerebrum portion 28, anterior to the eye projections 26. For a more life-like appearance, the simulated skull 14 is preferably covered with a flexible sheet material 32, such as leather, velvet, or the like, thereby enhancing the appearance of the trophy mount 10.

The horn mounting means 16 includes a round, elongated bore 34 located in each of the regions 30, and extending into the simulated skull 14. An elongated dowel 36 is received in each of the bores 34 and adhesively secured therein by glue 38. Mounting means 16 also includes a pair of elongated strips 40 of flexible sheet material, preferably of the same type as used in covering 32.

Figure 5:
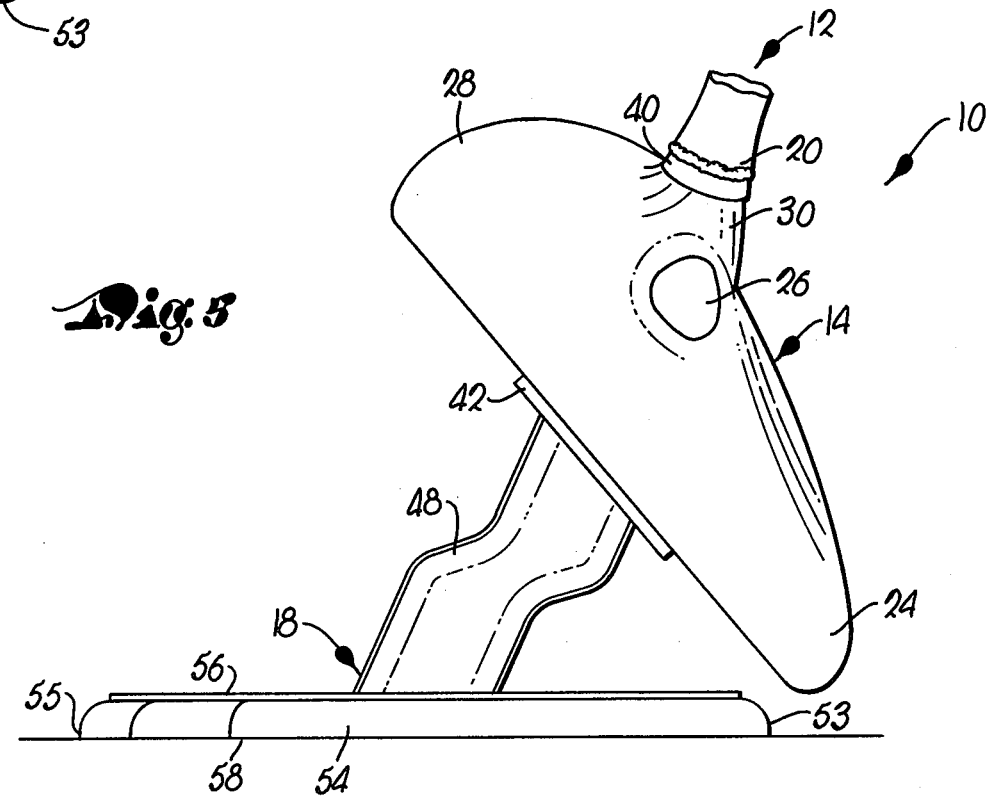
FIG. 5 is a side elevational view of the trophy mount, configured for display on a horizontal surface, such as a table top.

The display support 18 of the preferred embodiment as shown in FIGS. 1–4, anticipates display by hanging the trophy mount 10 on a wall or other vertical support surface, although the trophy mount 10 is easily modified, as shown in FIG. 5, for display on a table or other horizontal support medium. In the preferred embodiment, the display support 18 includes a flattened, rectangularly shaped plate 42 having structure defining apertures 44 at each corner thereof, and structure defining a pair of apertures 46 located towards the center of plate 42. Additionally, the support 18 includes an elongated extension brace 48 having first and second ends 50, 52 and a flattened plaque 54 representing convergent and divergent ends 53, 55 and first and second faces 56, 58. As may be appreciated, screws 60 are additionally provided for interconnecting the skull 14, brace 48, and plaque 54.

In use, the dowels 36 are adhesively secured in the respective bores 34 such that a portion of the dowel protrudes from the simulated skull 14. Each of the horns 12 is then secured to the respective dowel 36 by applying glue 38 to the dowel 36 and inserting the hole 22 over the dowel 36. Before the glue sets up, the horns 12 are rotated such that the spacing between the horns 12 and the skull structure 14 gives the most life-like appearance. The strips 40 are circumferentially wrapped around the horns 12 at the joinder of the horns 12 and skull 14, thereby covering any unsightly gaps. In mounting the simulated skull 14 to the display support 18, the plate 42 is first secured to the first end 50 of brace 48 by the screws 60 inserted through the apertures 46 into brace 48. Next, four screws 60 are respectively inserted through apertures 44 of plate 42 to engage simulated skull 14. Finally, end 52 of brace 48 is placed against face 56 of plaque 54 and secured by screws 60. By comparing FIGS. 4 and 5, it is seen that for vertical display, end 52 is oriented in such a manner that brace 48 extends towards a position perpendicular to divergent end 55 of FIG. 5, the end 52 is rotated on face 56, such that brace 48 extends towards a position perpendicular to convergent end 53 of plaque 54. As seen in FIG. 1, the completed trophy mount displays the rack in a natural, three-dimensional setting. More importantly, the trophy mount of the present invention is inexpensive and requires very little skill in mounting the horns.

I claim:

1. A trophy mount for displaying a pair of separate animal horns, antlers, or the like, comprising:

structure defining a simulated skull configured to resemble a portion of the head of said animal;

a pair of laterally spaced, horn-securing regions located on said structure in a substantially symmetrical manner;

means for mounting said separate animal horns respectively to a corresponding horn-securing region; and panel means for supporting said simulated skull structure.

2. A trophy mount as set forth in claim 1, said simulated skull structure including approximately the top two-thirds of the animal's head and comprising a molded synthetic resin material covered by a flexible sheet material.

3. A trophy mount as set forth in claim 1, said mounting means including structure defining an elongated hole in the end of one of said horns, structure defining an elongated bore in one of said regions, and an elongated dowel, complementally configured for sliding reception in said one bore and sliding insertion in said one hole.

4. A trophy mount as set forth in claim 3, said mounting means including an adhesive glue for securing said dowel in said bore and said hole.

5. A trophy mount as set forth in claim 1, said panel means including a flattened placque, an elongated brace extending outwardly from said placque, said brace affixed at one end to said placque and at the other end to said simulated skull structure.

6. A trophy mount for displaying a pair of separate animal horns, comprising:

a simulated skull structure generally ellipsoidal in shape having a generally planar bottom, an elongated, generally prolate spheroidal-shaped nose portion, wherein the surfaces of the skull structure generally converge, a generally oblate spheroidal-shaped, rounded cerebrum portion, a pair of spaced-apart eye sockets intermediate said nose and cerebrum portions, and a pair of spaced-apart, upraised, frustoconical shaped horn-securing regions intermediate said eye sockets and said cerebrum portion;

means for mounting said separate animal horns respectively to a corresponding horn-securing region including an elongated bore, centrally located in each of said regions and an elongated dowel fixedly secured in each of said bores and protruding therefrom; and means for supporting said skull structure presenting a flattened, surface-engaging plaque and an outwardly-extending, elongated, flattened extension secured at one end to said plaque and at said other end to said skull structure.

* * * * *